US006058514A

United States Patent [19]

Hart

[11] Patent Number: 6,058,514

[45] Date of Patent: May 9, 2000

[54] BUTTOCKS SUPPORT DEVICE

[76] Inventor: Karin Hart, 18462 Via Bravo, Villa Park, Calif. 92681

[21] Appl. No.: 09/187,011

[22] Filed: Nov. 4, 1998

[51] Int. Cl.[7] ..... A41B 9/00

[52] U.S. Cl. ..... 2/406; 2/408; 2/67; 450/101; 450/155

[58] Field of Search ..... 2/406, 408, 400, 2/311–312, 67, 69; 450/155, 100, 101, 106, 107, 129–134, 136, 137, 148

[56] References Cited

U.S. PATENT DOCUMENTS

| | | | |
|---|---|---|---|
| D. 042,195 | 4/1912 | Street . | |
| D. 395,735 | 7/1998 | Baramore . | |
| 1,119,944 | 12/1914 | Entsch . | |
| 1,642,279 | 9/1927 | Volkert, Jr. | 450/155 |
| 1,834,046 | 12/1931 | Brooks . | |
| 2,027,622 | 1/1936 | Stam . | |
| 2,088,800 | 8/1937 | Malouf | 2/406 |
| 2,377,651 | 6/1945 | Roseman . | |
| 2,710,486 | 6/1955 | Blatt . | |
| 3,094,990 | 6/1963 | Neilson | 2/406 |
| 3,524,449 | 8/1970 | Peters | 450/155 |
| 4,121,305 | 10/1978 | Kolker | 2/406 |
| 4,501,024 | 2/1985 | Russo | 2/67 |
| 4,698,847 | 10/1987 | Yoshihara | 2/69 |
| 4,932,079 | 6/1990 | Bridgewater | 2/313 |
| 4,984,304 | 1/1991 | Brown . | |
| 5,143,092 | 9/1992 | Flowers . | |
| 5,485,636 | 1/1996 | Yandell | 2/406 |
| 5,535,451 | 7/1996 | Tassone et al. . | |
| 5,784,723 | 7/1998 | Noble et al. | 2/400 |
| 5,876,395 | 3/1999 | Hart et al. . | |
| 5,888,118 | 3/1999 | Kishi . | |
| 5,902,170 | 5/1999 | Ganz | 2/406 X |

FOREIGN PATENT DOCUMENTS

| | | |
|---|---|---|
| 0224618 | 6/1987 | European Pat. Off. . |
| 9-49103 | 6/1997 | Japan . |

*Primary Examiner*—Gloria M. Hale
*Attorney, Agent, or Firm*—Richard B. Klar

[57] ABSTRACT

A Buttocks Support Device is disclosed. Also disclosed is a support device that comprises an abdominal ring and a pair of thigh rings. Each thigh ring comprises a buttock section and a solar plexus section, the buttock section being configured to lift and restrain the wearer's buttock. The preferred device includes a sleeve thereover for permitting the "rings" to be tightened without pulling on the wearer's skin. It is a further aspect that the device anchor at either the waist or the hips, depending upon the wishes of the wearer. Still further, the thigh rings include adjustment means for adjusting the length of the thigh rings. Furthermore, the preferred abdominal ring includes means for attaching and detaching the device from around the wearer's waist.

14 Claims, 7 Drawing Sheets

BUTTOCKS SUPPORT DEVICE

Reference is made to co-pending design patent application U.S. Ser. No. 29/104,278 filed on May 1, 1999 by the applicant for this invention.

BACKGROUND OF THE INVENTION

1. Field of the Invention

This invention relates generally to support garments and, more specifically, to a Buttocks Support Device.

2. Description of Related Art

In today's society both women and men have become increasingly more concerned with their appearance. A variety of approaches are being taken to improve one's physical appearance, including cosmetic surgery, exercise, dieting, as well as enhancements to the body shape acquired through the wearing of a variety of undergarments. The problem with these previous below-the-waist undergarments, is that none lifts, supports, and shapes a person's buttocks similar to the underwire bra that is a fairly common undergarment for women today. While there have been a variety of devices that add padding or some other shape to the buttock, none actually lift it, while also giving a desirable shape.

Furthermore, as mentioned earlier, after cosmetic surgery involving liposuction or other such procedure to the buttock area it is a standard procedure for the patient to be required to wear some sort of garment, such as shorts or a girdle or other device. These devices press the skin into the desired position while the skin re-attaches to the structure beneath it. The problem with wearing these stretch pants and girdles is that they are extremely uncomfortable. In the days following these liposuction procedures the skin is extremely tender and therefore the last thing that the patient wants is to have something pressing against the surfaces that were just bruised during the surgery. What's needed is a less intrusive means for holding the skin into the desired position after liposuction surgery until the skin re-attaches to the underlying structure of the person's body.

SUMMARY OF THE INVENTION

In light of the aforementioned problems associated with the prior devices, it is an object of the present invention to provide a Buttocks Support Device. The preferred support device will comprise an abdominal ring and a pair of thigh rings. Each thigh ring will preferably comprise a buttock section and a solar plexus section, the buttock section being configured to lift and restrain the wearer's buttock. It is a further object that the device include a sleeve thereover for permitting the "rings" to be tightened without pulling on the wearer's skin. It is a still further object that the device anchor at either the waist or the hips, depending upon the wishes of the wearer. It is a still further object that the thigh rings include adjustment means for adjusting the length of the thigh rings. Furthermore, the preferred abdominal ring will include means for attaching and detaching the device from around the wearer's waist.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out her invention. Various modifications, however, will remain readily apparent to those skilled in the art, since the generic principles of the present invention have been defined herein specifically to provide a Buttocks Support Device.

Figure 1:
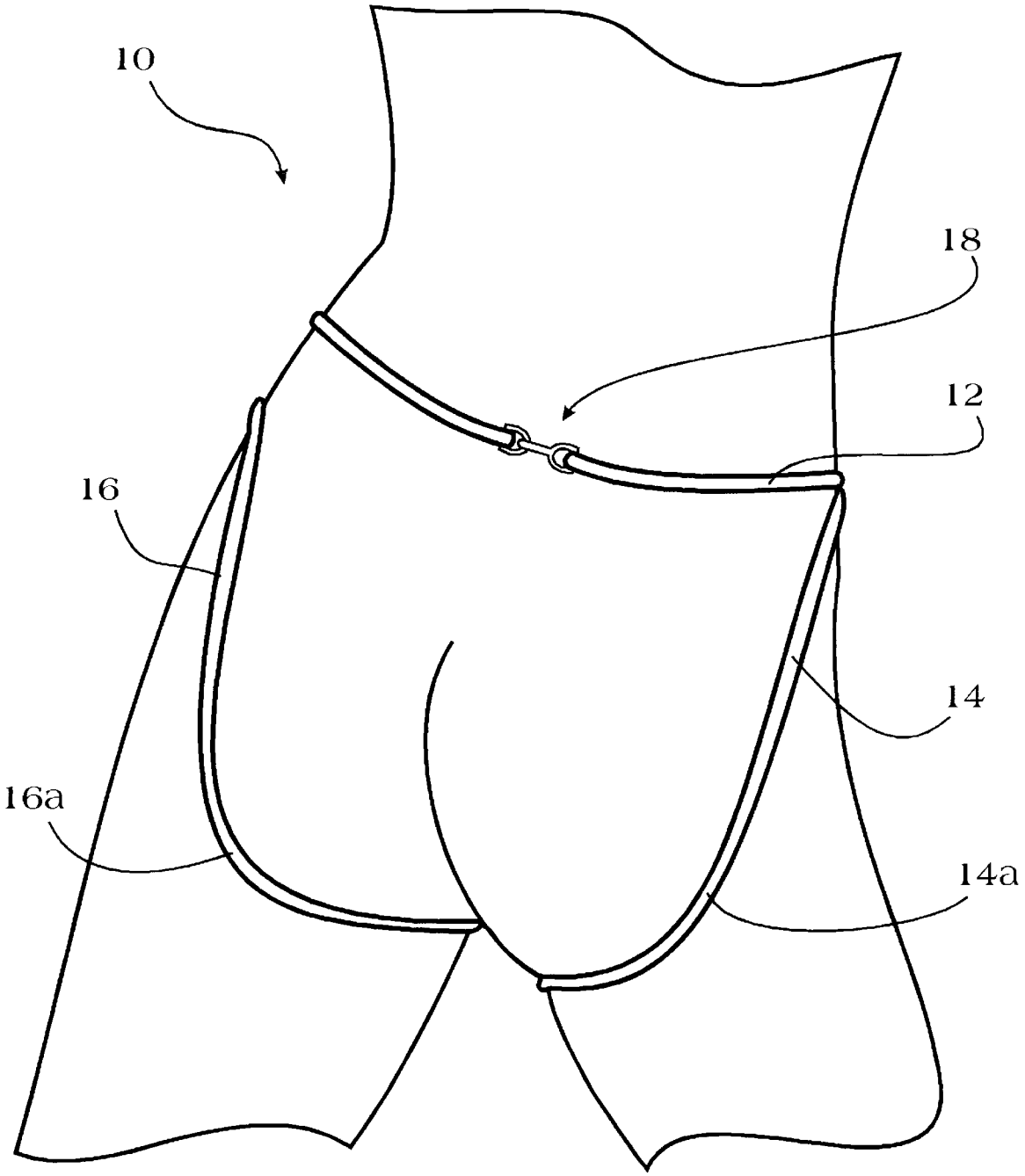
FIG. 1 is a back view of a preferred buttocks support of the present invention as it might be worn by an individual.

The present invention can best be understood by initial consideration of FIG. 1. FIG. 1 is a back view of a preferred buttocks support 10, of the present invention as it might be worn by an individual. As seen from the back, the device comprises abdominal ring 12, and a pair of thigh rings 14 and 16, respectively. Each thigh ring comprises a buttock section 14*a* and 16*a*, respectively. As can also be seen, each thigh ring, 14 and 16, encircle the buttock at the lower and outer edges thereof to lift and shape the buttock, while still leaving the center (cleft) area open. Furthermore, the abdominal ring 12, might also include attachment means 18, to permit the donning and removing of the buttocks support 10. It should be understood that while the abdominal ring 12 is shown at the wearer's hip level, it might be re-positioned to the wearer's waist, as desired. Also, the support 10 might comprise a sleeve (not shown) over a portion or substantially all of the support 10. The sleeve (not shown) would permit the user to tighten or loosen the support 10 without pulling on the skin. The sleeve (not shown) is preferably constructed from cloth or other conventional covering so as to permit easy slipping of the cords of the support 10.

Figure 2:
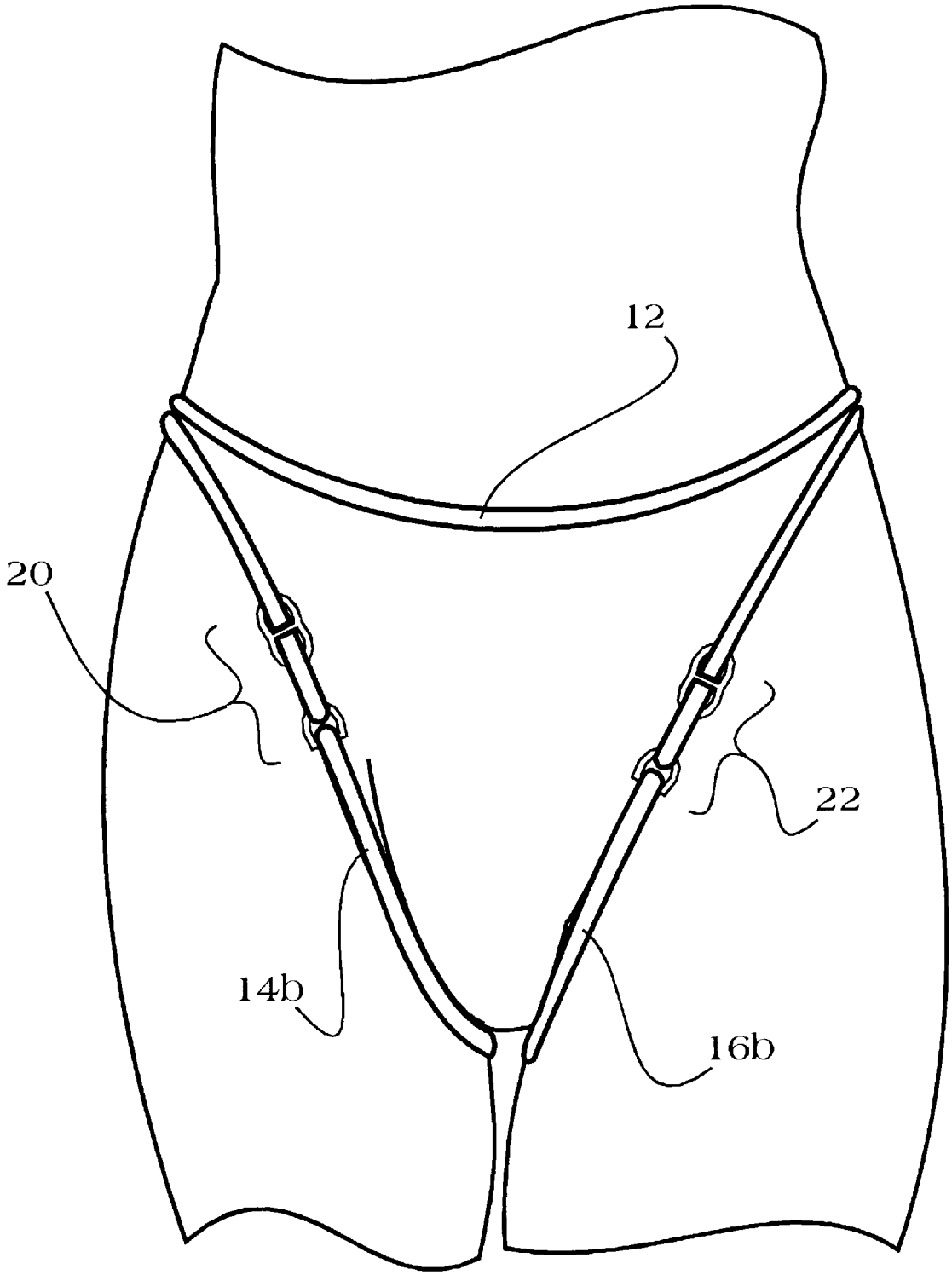
FIG. 2 is a front view of the buttocks support of FIG. 1 as worn by an individual.

Now turning to FIG. 2 we can examine other aspects of this unique invention. FIG. 2 is a front view of the preferred buttocks support 10 of the present invention as depicted in FIG. 1. As can be seen, the abdominal ring 12 encircles the abdomen to provide support for the thigh rings 14 and 16. As should be appreciated, the thigh ring 14 is comprised of a buttock section 14*a* as depicted in FIG. 1 and a solar plexus section 14*b* as depicted here in FIG. 2. Similarly the thigh ring 16 comprises a buttock section 16*a* as depicted in FIG. 1 as well as a solar plexus section 16*b* depicted here in FIG. 2. Essentially, then, each thigh ring 14 and 16 is a loop passing through the crotch and around the buttock in the rear and across the solar plexus area in the front. Furthermore, each solar plexus section further includes adjustment means 20 and 22, for adjusting the length of the solar plexus section. It should be understood that as the solar plexus section is tightened, via the adjustment means 20 for example, the buttock section 14*a* will also be tightened, therefore snugging up on the buttock area of the wearer. It is pointed out that the buttock section 14*a*, for example, and solar plexus section 14*b*, for example, might terminate at separate locations on the abdominal ring 12, such that a portion of the abdominal ring 12 actually forms a portion of the thigh rings 14 and 16.

Figure 3B:
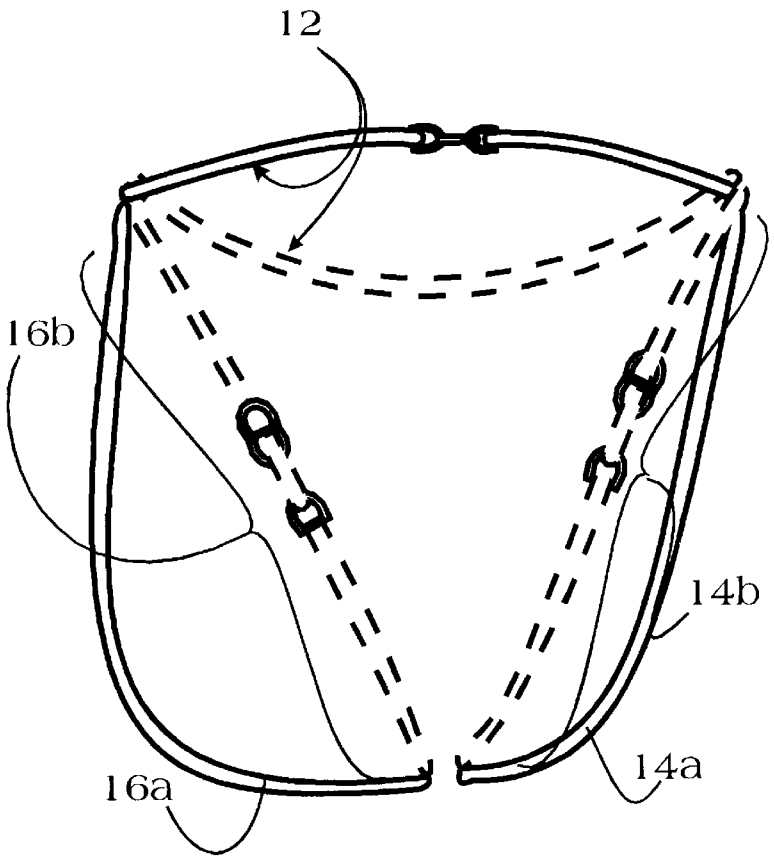
FIGS. 3A and 3B are front and back views, respectively, of the buttocks support of FIGS. 1 and 2.
Figure 3A:
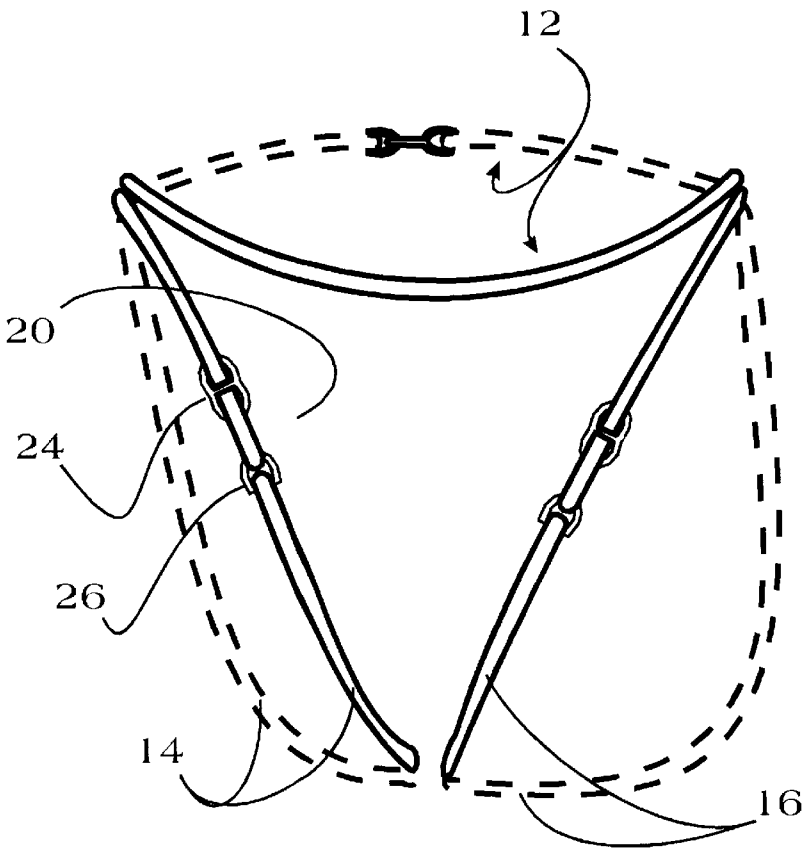

Now turning to FIGS. 3A and 3B we will discuss specific aspects of this present invention. FIG. 3A is a front view of the preferred buttocks support 10 depicted in FIGS. 1 and 2. In this embodiment the abdominal ring 12, and thigh rings 14 and 16, are made from a flexible, however non-stretchable material such as nylon cording, nylon straps, or even some fashion of comfortable rope, etc. Essentially each thigh ring 14 and 16, attaches to the abdominal ring 12 by snaps, by being sewn, or by other conventional means. The attachment means 18, can be any sort common in the art such as a hook and loop, a snap, a button, or even a tied knot—it further might be positioned at any of a variety of locations around the abdominal ring 12. Also, the adjustment means, for example element 20, could be simply a conventional slide and loop arrangement, such that movement of the slide, 24 closer to the loop 26 will lengthen the thigh ring 14, and therefore loosen the fit on the wearer. Conversely, moving the slide 24 away from the loop 26 will result in tightening the thigh ring 14, therefore creating a tighter fit for the user. FIG. 3B is simply a back view depicting the curvature of the buttock sections, 14*a* and 16*a*, as they encircle around each buttock.

Figure 4B:
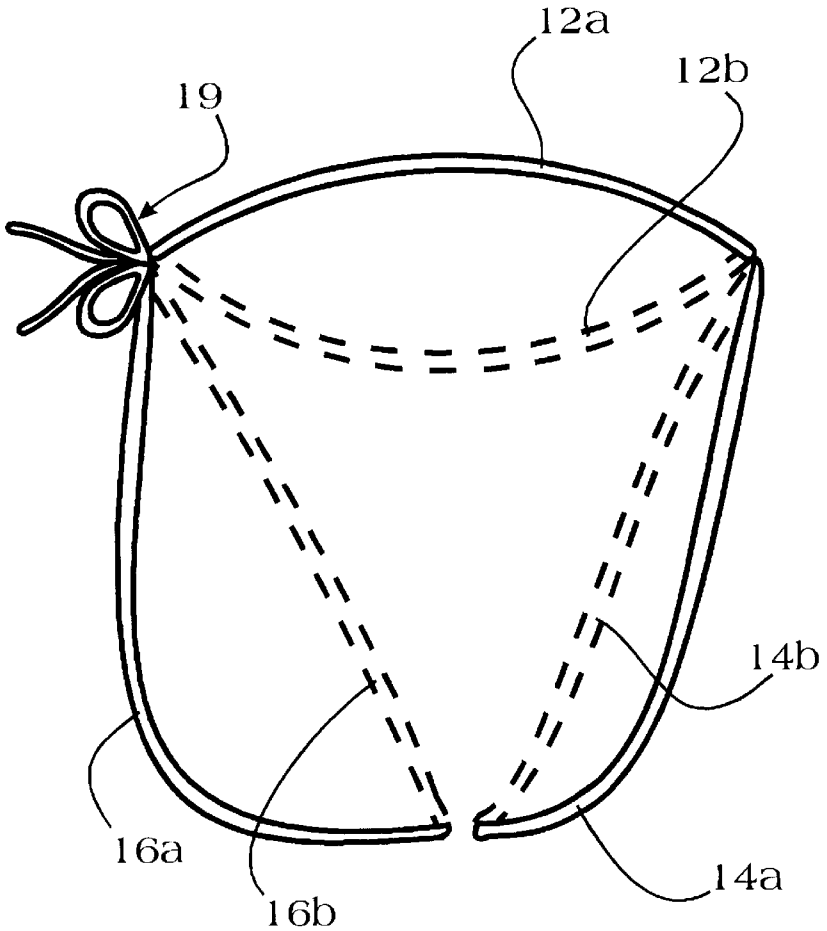
FIGS. 4A and 4B are front and back views, respectively, of another preferred buttocks support of the present invention having a unitary support member.
Figure 4A:
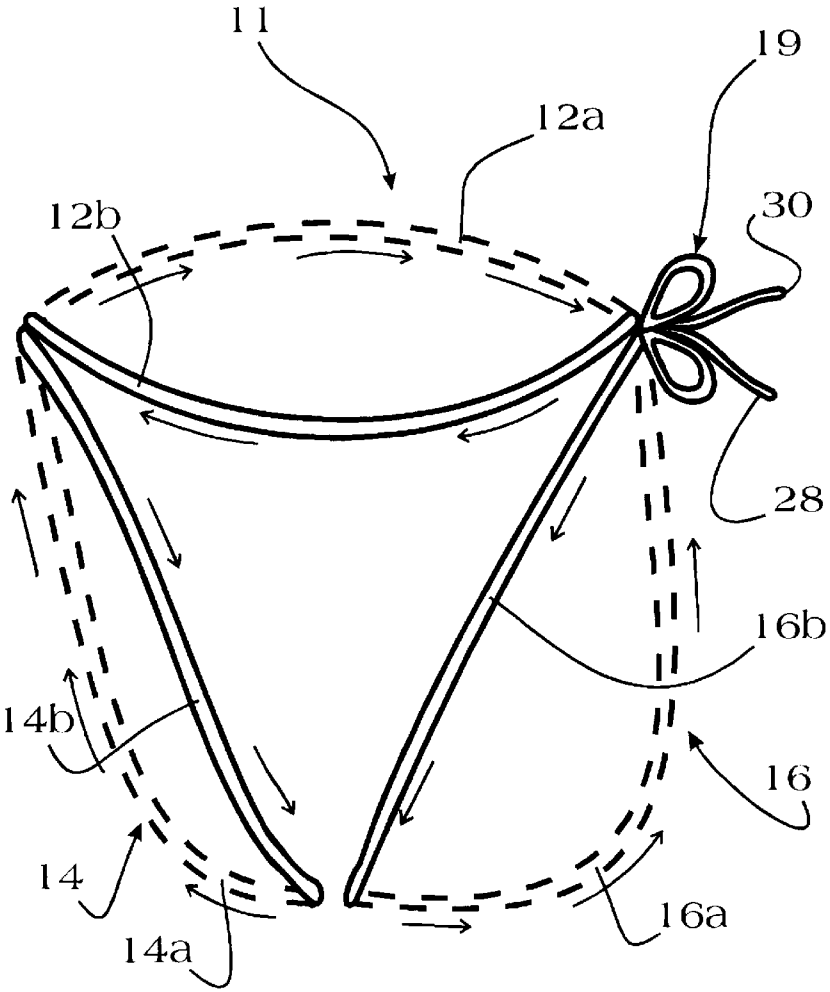

Now turning to FIGS. 4A and 4B we can discuss yet another preferred embodiment of the present invention showing a device made from the unitary support member. FIGS. 4A and 4B are front and back views, respectively, of another preferred buttocks support of the present invention having a unitary support member. In this case the entire buttocks support, 11, is made from a single piece of cording, strapping or other material as described above in connection with FIGS. 1 through 3. By way of example we will discuss one possible arrangement of this unique buttock support, 11. In this case, the cord has a first end 28 which might then pass down the wearer's solar plexus, thereby making the solar plexus section 16*b*, then through the crotch and back up around the buttock to form the buttock section 16*a*. The cord would then perhaps loop around itself and across the abdomen forming the front section of the abdominal ring 12*b*. Similarly on the right side the cord will pass around the solar plexus forming the solar plexus section 14*b*, then through the crotch and back up around the buttock to form the buttock section 14*a*. Again passing through itself at the waist or hip, the cord will pass around the back of the abdomen, thereby forming the rear section of the abdominal ring 12*a*, and then back to the origin at the first end 28. At this point the first end 28 and the second end 30 will be attached to one another via an attachment means 19 (shown here as a simple knot). It should be understood that this is one example of a sequence for wrapping the cord around one's self; certain persons may prefer another route—there is no distinction the route shown and some other route, as long as the abdominal ring 12 and thigh rings 14 and 16 are formed in the process. While in some respects the embodiment of FIGS. 4A and 4B might be more complicated then those previously discussed in connection with FIGS. 1 through 3 it is also simpler. It can be donned and adjusted by tightening or loosening this single cord until the proper fit is desired. Furthermore, this device will transfer and or self-adjust between each thigh ring and the abdominal ring while being worn, possibly making it more comfortable for the user.

Figure 5B:
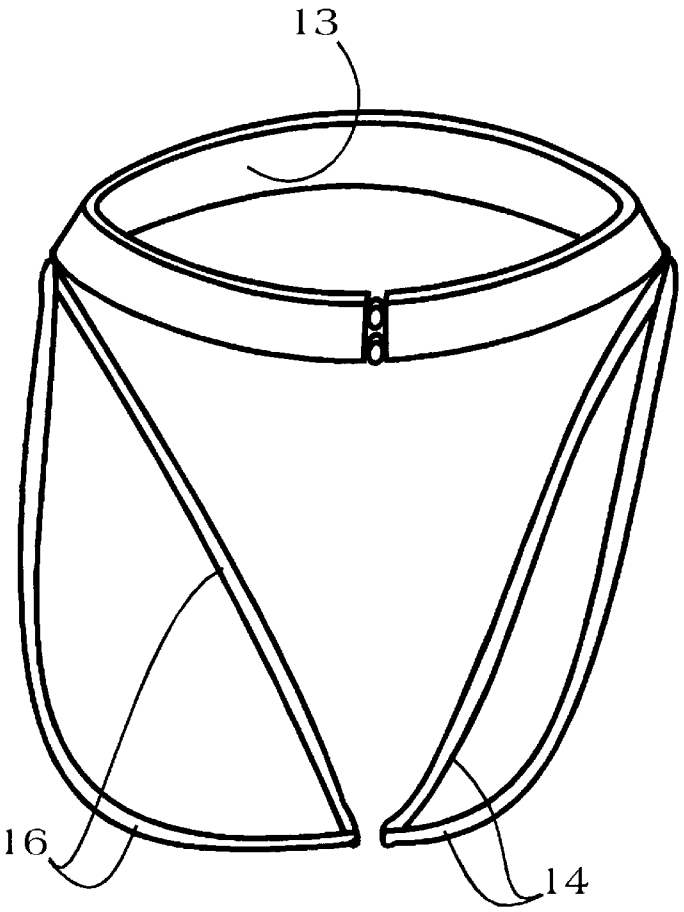
FIGS. 5A and 5B are front and back views, respectively, of another preferred buttocks support of the present invention having a panel-type abdominal ring.
Figure 5A:
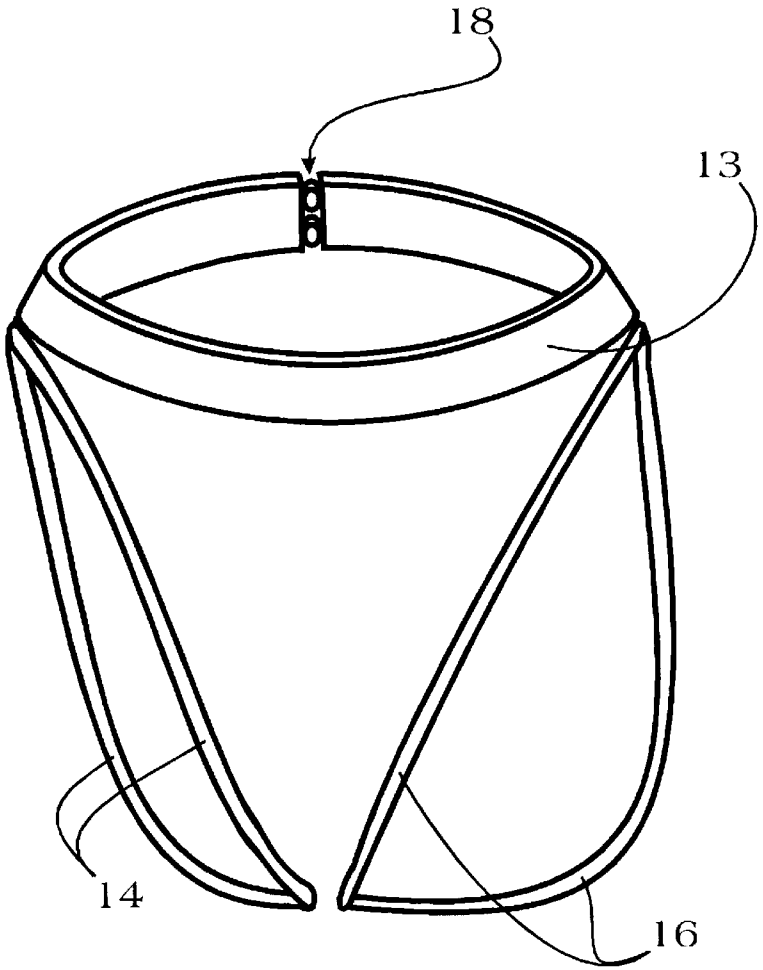

Now turning to FIGS. 5A and 5B we can review yet another embodiment of the present invention. FIG. 5A is a front view of still another preferred embodiment of the present invention. In this case an alternative abdominal ring 13 is employed. Abdominal ring 13 is potentially substantially wider than those previously discussed. In addition to potentially providing more comfort to the wearer it may also provide a more decorative garment and in fact may be constructed from lace or other material such that it looks similar to a corset, etc. Furthermore, the attachment means 18 used here would be very similar to those used for the embodiments of FIGS. 1 through 3. However, rather than one loop there may be several loops or even a zipper, etc., also, it should be appreciated that the alternative the abdominal ring 13 may also be constructed from leather, elastic, or other conventional material.

Figure 6:
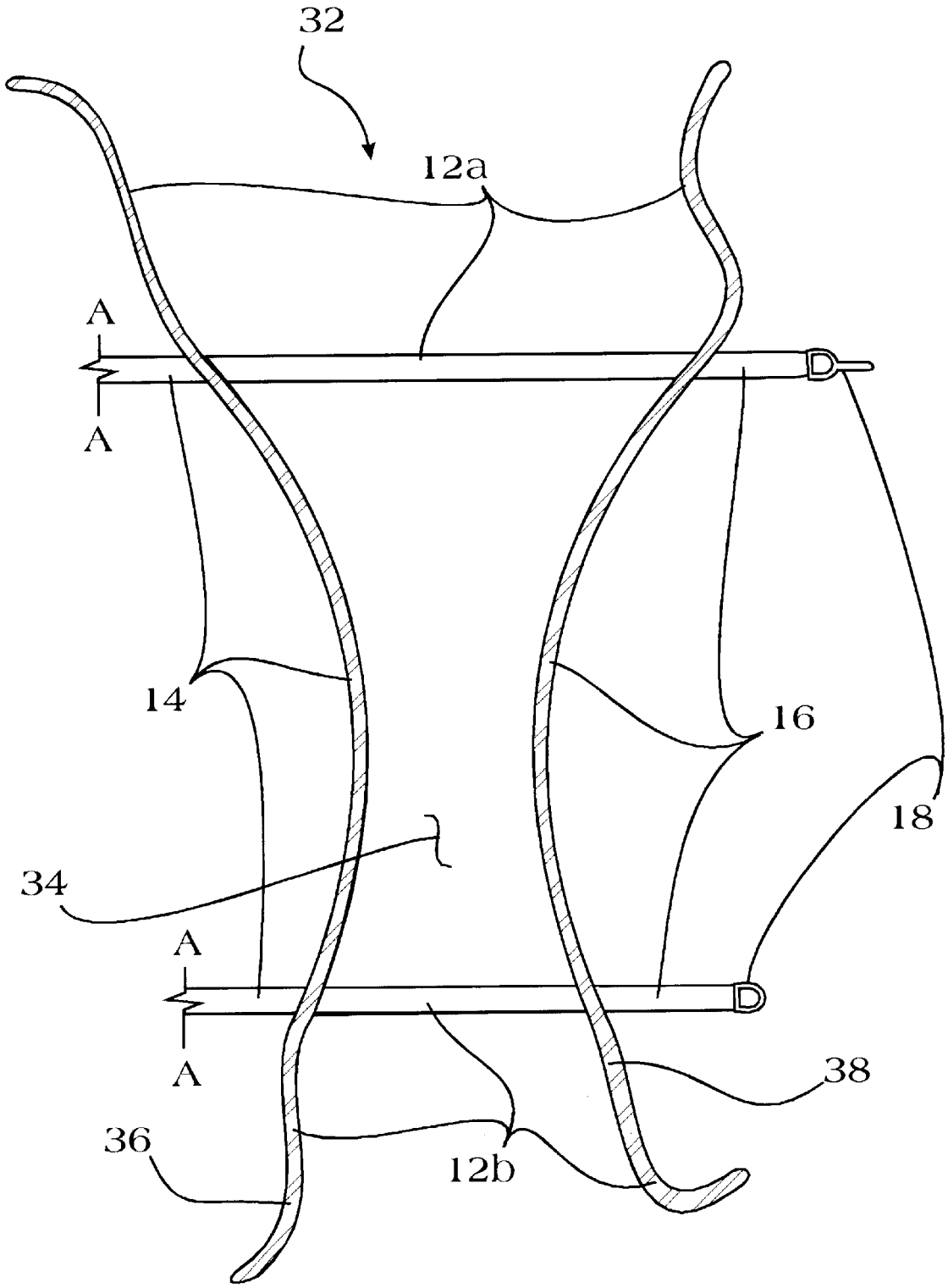
FIG. 6 is a top view of yet another preferred buttocks support of the present invention.
Figure 7B:
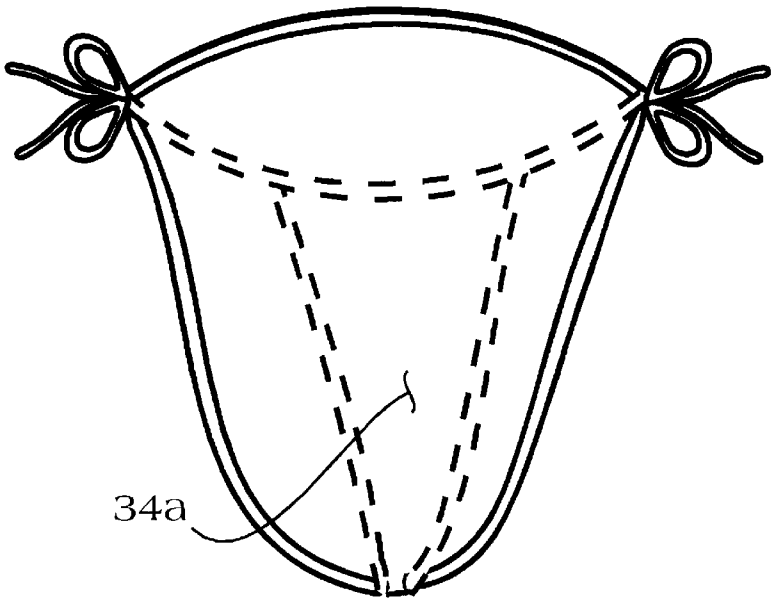
FIGS. 7A and 7B are front and back views, respectively, of the buttocks support of FIG. 6.
Figure 7A:
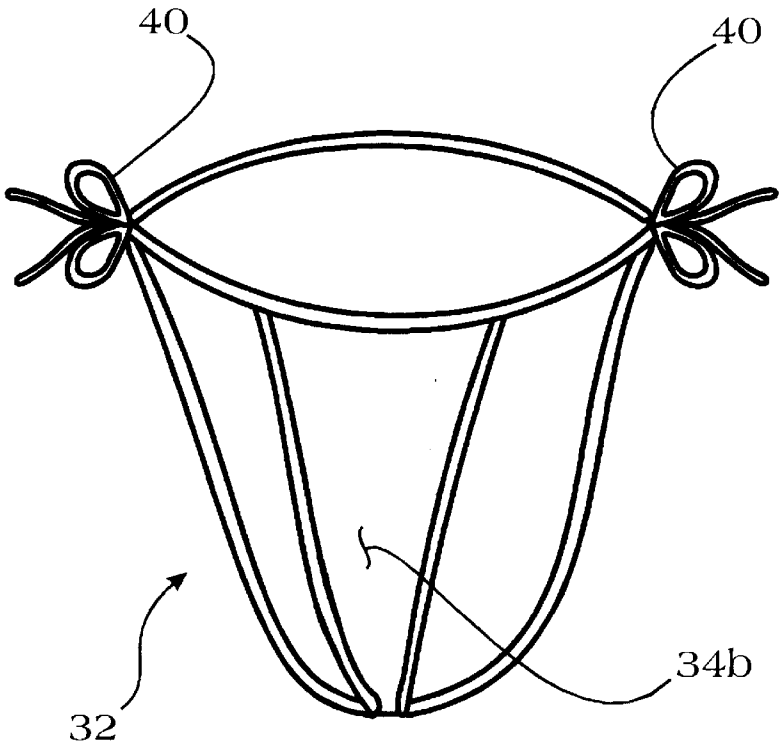

Now turning to FIGS. 6, 7A and 7B we can discuss yet another preferred embodiment of the present invention. FIG. 6 is a top view of yet another preferred buttocks support of the present invention; and FIGS. 7A and 7B are front and back views, respectively, of the buttocks support of FIG. 6. As can be seen this buttock support 32, comprises a center panel 34, such as from lace or other material, and a pair of cords 36 and 38 running along the edges thereof The unique aspect of this invention is that the cords 36 and 38 are attached to the center panel 34 in a sliding fashion, such as through a open hem in the opposing edges of the center panel 34. The thigh rings 14 and 16 are made up from the section of the cords 36 and 38 passing through the edges of the center panel 34. The end portions of the cords 36 and 38 go on to form the front and rear sections of the abdominal ring 12*b* and 12*a*, respectively. FIGS. 7A and 7B depict how this bikini type buttock support 32 is worn. In this case the two cords 36 and 38 are tied at each hip to form the alternative attachment means 40. Other means for attaching the cords 36 and 38 to themselves might be used such as snaps, loops or other methods. As can be seen once the buttock support 32 is put on there will be a center panel 34, having a front section 34*b*, and a rear section 34*a*, thereby providing cover for the wearer in addition to the lift and support provided by the thigh rings 14 and 16.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A buttocks support device for supporting and lifting a user's buttocks, comprising:

an abdominal ring adapted to encircle of a user's waist;

a pair of thigh rings each formed of a supporting member having two ends each adapted to be connected to a portion of said abdominal ring, each said supporting member being connected to a front portion of said abdominal ring near a user's front waist area and adjacent a user's pelvic area, a remaining portion of each said supporting member being placed past a respective one of a user's inner thigh area and under a user's groin area and being adapted to framingly encircle a bottom surface of a respective buttock of a user and being adapted to attach at a portion of said abdominal ring near a user's hip area so that each said supporting member supports and lifts a user's buttock.

2. The buttocks support device according to claim 1 wherein said pair of thigh rings are formed of an elastic straplike material.

3. The buttocks support device according to claim 1 wherein said pair of thigh rings are formed of a rigid strap-like material.

4. The buttocks support device according to claim 1 wherein said pair of thigh rings each contain an adjusting means to adjust each said thigh ring to a user's size.

5. The buttocks support device according to claim 1 wherein said abdominal ring is formed of an elastic strap-like material.

6. The buttocks support device according to claim 1 wherein said abdominal ring is formed of a rigid strap-like material.

7. The buttocks support device according to claim 1 wherein said abdominal ring contains an adjusting means to adjust said abdominal ring to a user's size.

8. The buttocks support device of claim 4 wherein each said adjusting means includes a slide and a loop, and said adjusting means include sliding said slide either towards or away from said loop.

9. The abdominal ring of claim 1 wherein each said adjusting means includes a slide and a loop, and said adjusting means include sliding said slide either towards or away from said loop.

10. The buttocks support of claim 4 wherein said abdominal ring comprises an elongate member having opposing ends, said abdominal ring further comprising attachment means for attaching and detaching one of said ends to and from another said ends.

11. The buttocks support of claim 10 wherein said attachment means comprises a hook attached to said one of said ends and a loop attached to said another of said ends, said hook and loop cooperating to provide said attaching and detaching.

12. The buttocks support of claim 10 wherein said abdominal loop comprises a flat, pliable material.

13. The buttocks support of claim 1 further comprising a center panel extending between each said thigh ring.

14. A method for supporting and lifting a user's buttocks, the steps comprising:

encircling a user's waist with an abdominal ring; and supporting a user's buttocks with a pair of thigh rings each formed of a supporting member having two ends each adapted to be connected to a portion of said abdominal ring, each said supporting member being connected to a front portion of said abdominal ring near a user's front waist area and adjacent a user's pelvic area, a remaining portion of each of said supporting member being placed past a respective one of a user's inner thigh area and under a user's groin area and being adapted to frame and encircle a bottom surface of a respective buttock of a user and being adapted to attach at a portion of said abdominal ring near a user's hip area so that each said supporting member supports and lifts a user's buttock.

* * * * *